US005134261A

United States Patent [19]

Larkin et al.

[11] Patent Number: 5,134,261

[45] Date of Patent: Jul. 28, 1992

[54] APPARATUS AND METHOD FOR CONTROLLING GRADIENTS IN RADIO FREQUENCY HEATING

[75] Inventors: John J. Larkin, South Boston, Mass.; Meckie T. Harris, Nashua, N.H.; Alton F. Armington, Lexington, Mass.

[73] Assignee: The United States of America as represented by the Secretary of the Air Force, Washington, D.C.

[21] Appl. No.: 503,494

[22] Filed: Mar. 30, 1990

[51] Int. Cl.[5] ..... H05B 6/00

[52] U.S. Cl. ..... 219/10.41; 219/10.491; 219/10.75; 373/139; 422/246; 422/248; 156/DIG. 96

[58] Field of Search ..... 219/10.41, 10.491, 10.75, 219/10.77, 10.43, 10.67; 373/139, 155, 156; 422/246, 248, 249; 156/DIG. 96, DIG. 83

[56] References Cited

U.S. PATENT DOCUMENTS

| | | | |
|---|---|---|---|
| 1,975,436 | 10/1934 | Sorrel et al. | 219/10.41 |
| 4,442,332 | 4/1984 | Jackson et al. | 219/10.41 |
| 4,450,333 | 5/1984 | Andrejco et al. | 219/10.49 R |
| 4,590,347 | 5/1986 | Thatcher et al. | 219/10.49 R |
| 4,608,473 | 8/1986 | Paek et al. | 219/10.45 R |
| 4,610,017 | 9/1986 | Perrier de la Bathie | 373/156 |
| 4,629,851 | 12/1986 | Holle | 219/10.81 |
| 4,752,451 | 6/1988 | Aubert et al. | 422/250 |

*Primary Examiner*—Bruce A. Reynolds
*Assistant Examiner*—Tu Hoang
*Attorney, Agent, or Firm*—Stanton E. Collier; Donald J. Singer

[57] ABSTRACT

A composite susceptor for a radio frequency (RF) heated crystal growing furnace has a plurality of stacked electrically insulating and electrically conducting elements about the crucible area so that a proper temperature gradient is established and controlled.

23 Claims, 3 Drawing Sheets

FIG. 4A
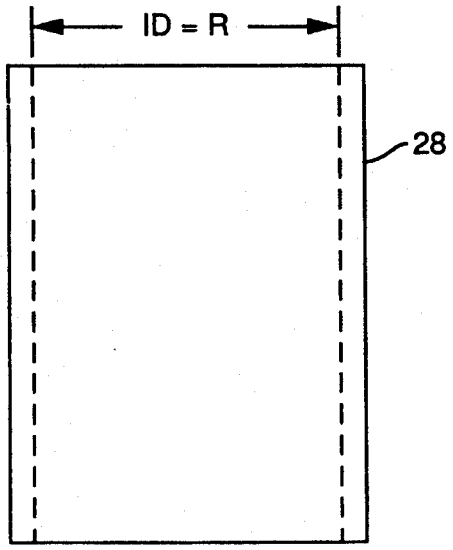
FIG. 4B
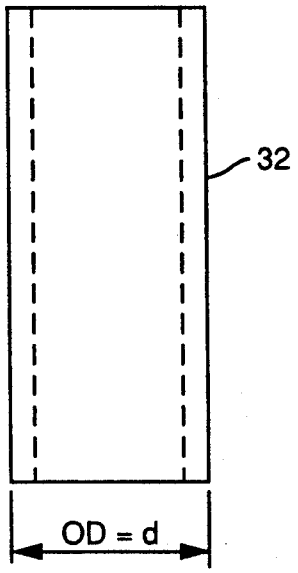
FIG. 4C
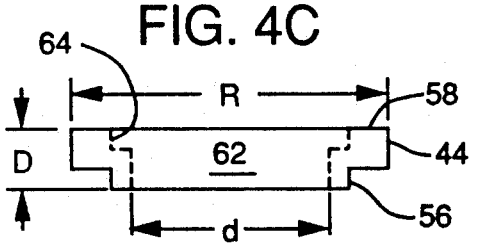
FIG. 4E
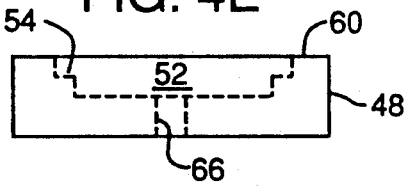
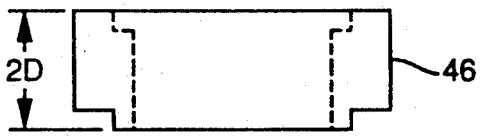
FIG. 4D
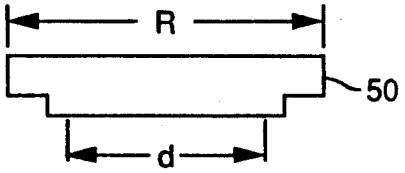
FIG. 4F

APPARATUS AND METHOD FOR CONTROLLING GRADIENTS IN RADIO FREQUENCY HEATING

STATEMENT OF GOVERNMENT INTEREST

The invention described herein may be manufactured and used by or for the Government for governmental purposes without the payment of any royalty thereon.

BACKGROUND OF THE INVENTION

The present invention relates to crystal growth furnaces, and, in particular, relates to radio frequency heating of the crystal growth furnaces.

Radio frequency (RF) heating has long been used as a convenient, efficient method of directly or indirectly heating materials in a furnace. The technique depends on the fact that an electrically conducting material will have currents induced within it in the presence of an RF field. These currents will generate heat within the conductor by Ohms law. The amount of power generated will depend on the product of the square of the induced current (a function of the resistivity of the material and the magnetic field strength produced in the material by the RF field) and the resistivity of the material over the induced current paths. The efficiency of current (and therefore heat) production depends on the electrical properties of the material, the frequency of the RF field, and geometric factors depending on the shape and proximity of the RF source. These geometric factors are of importance since they can be adjusted such that power is coupled only into the areas required and not into other conductors in the vicinity (e.g., a crystal growth chamber).

Typical configurations in the materials processing and crystal growth areas are cylindrical. A helical coil (water cooled to carry off ohmic heat within the coil) is powered by an RF generator. Frequencies used are typically between 0.4 and 10 Mhz, and the output currents to the coils of hundreds of amps are common. The cylindrical geometry concentrates fields inwards toward the material to be heated. Although in some applications conducting materials are directly coupled to the RF field, it is more common to heat an external conductor being called a susceptor and transferring heat to the charge by thermal radiation or conduction.

Especially at low frequencies, the RF wavelength is much longer than the total length of the coil. The currents in the coil generate axial magnetic fields with the frequency of the RF field. These in turn generate circumferential currents in the charge or susceptor. Typical susceptor configurations are cylindrical tubes, either open or closed on the ends. A special purpose configuration is a susceptor designed as a crucible or crucible holder. This is used to contain liquid materials, typically for crystal growth.

The prior technique for obtaining precise control over temperature gradients used resistance heated furnaces with multiple power supplies and control loops.

Control of the temperature gradients in the RF environment can be difficult. Some control can be achieved by the position of the susceptor or the charge in the coil. Helical coils in which the pitch of the helix varies have been used to increase coupling in one part of the susceptor or charge in another. Design of such coils is not simple since the magnetic fields produced by each turn of the coil are vector additive and are constantly changing in direction and magnitude. Finally, some control of the temperature gradients produced may be achieved by appropriate use of thermal radiation shields which selectively allow heat to escape from various parts of the working area. These shields must in general be made of electrically non-conducting materials or they too will couple to the RF field.

Two techniques which require very careful control of temperature gradients involve directional solidification of melts to produce single crystals. The Bridgman technique, FIG. 1, ideally operates in a temperature environment in which two relatively long constant temperature zones are separated by a short region in which the temperature varies linearly between the two temperatures. The hotter (upper) zone is held at a temperature somewhat above the melting point of the material to be grown and the cooler (lower) zone somewhat below the melting point. The melt is confined in a crucible and slowly lowered in this thermal environment. In a nearly planar position in the short zone in which the temperature varies, corresponding to the melting point of the material, crystallization of the melt occurs. If conditions are appropriate the material will grow as a single crystal. This may be promoted by including a seed at the bottom of the crucible which is not completely melted, or by having a sharp point or reentrant area at the bottom of the crucible which promotes the formation of only a single seed nucleus.

Gradient freeze growth, FIG. 2, is a similar technique for directional solidification and crystal growth. In this technique a rather small linear gradient is maintained across the ampoule containing the melt (hotter at the top than at the bottom). The absolute temperature at the bottom is adjusted so that all of the material is melted except for possibly a section of single crystal seed. The temperature at some point in the system is then controlled and linearly decreased with time while the gradient is maintained. The plane containing the melting point of the material moves upward in the work area and thus the crystal solidifies from the bottom up as in the Bridgman system, FIG. 2. In this technique there is no physical movement of the components. The position of the plane containing the melting point is controlled by the power input to the system.

Control of the thermal gradients in an RF heated environment such as the above has traditionally involved placement of heat and radiation shielding to make some area in the environment lose heat more rapidly than others or control of geometric factors such as the position of the susceptor in the coil, the geometry of the coil or the position of the material to be heated within the susceptor. Modification of the thermal environment to attain precise thermal conditions is tedious and basically a trial and error method, and the end results of changes in these parameters are not easily predictable thus wasting numerous hours, materials and energy.

Clearly, there is a need to be able to obtain precise thermal control when using RF fields to provide heat.

SUMMARY OF THE INVENTION

This invention details a method and apparatus by which controlled temperature gradients may be produced in a radio frequency (RF) induction furnace by using composite susceptors fabricated from electrically insulating and conducting elements. Induction coil design is not a critical factor in this invention, and the electrical insulators and conductors may be chosen to have additional features to enhance the performance of the system by selecting desired physical properties. Among these properties are chemical resistance (e.g., resistance to oxidizing or reducing atmospheres) and directional thermal conductivity.

The invention involves the use of discrete electrically conducting cylindrical elements as susceptors, alternated with electrically insulating cylindrical elements. Properties and sizes may be chosen to produce essentially any desired internal thermal environment. Ordinary graphite is a suitable material for conducting elements in most inert, vacuum, or reducing environments. In an oxidizing environments, or in general where graphite is not suitable, refractory or precious metals may be used. Materials such as alumina, zirconia ceramic, fused silica, hot pressed boron nitride, beryllia, mullite, or a variety of other electrically insulating refractory materials may be used as insulating elements providing that they are compatible with the conducting elements at the temperatures involved and are inert to the ambient atmosphere. Other properties involved in the selection of the insulating elements are thermal conductivity and optical and infrared transmission. An insulator with low thermal conductivity which is transparent to thermal radiation can be used to produce large gradients in short distances. Insulating elements with high thermal conductivity such as beryllia ceramic or aluminum nitride ceramic would be more useful for small, slowly varying gradients.

It is therefore one object of the present invention to provide a means of controlling the temperature gradient in radio frequency (RF) induction furnaces.

Another object of the present invention is to provide an apparatus for controlling the temperature gradient in an RF induction furnace that is essentially independent of the coil design and can be rapidly changed to alter the gradient.

Another object of the present invention is to provide an apparatus for controlling the temperature gradient in a RF induction furnace being inert to the chemical environment and having desired heat conducting properties.

Another object of the present invention is to provide an apparatus for controlling the temperature gradient in an RF induction furnace that is easily manufactured and adapted to different furnaces.

These and many other objects and advantages of the present invention will be readily apparent to one skilled in the pertinent art from the following detailed description of a preferred embodiment of the invention and the related drawings.

BRIEF DESCRIPTION OF THE DRAWINGS

FIGS. 4A to 4F illustrate by side view elements of the present invention.

DESCRIPTION OF THE PREFERRED EMBODIMENT

Figure 1:
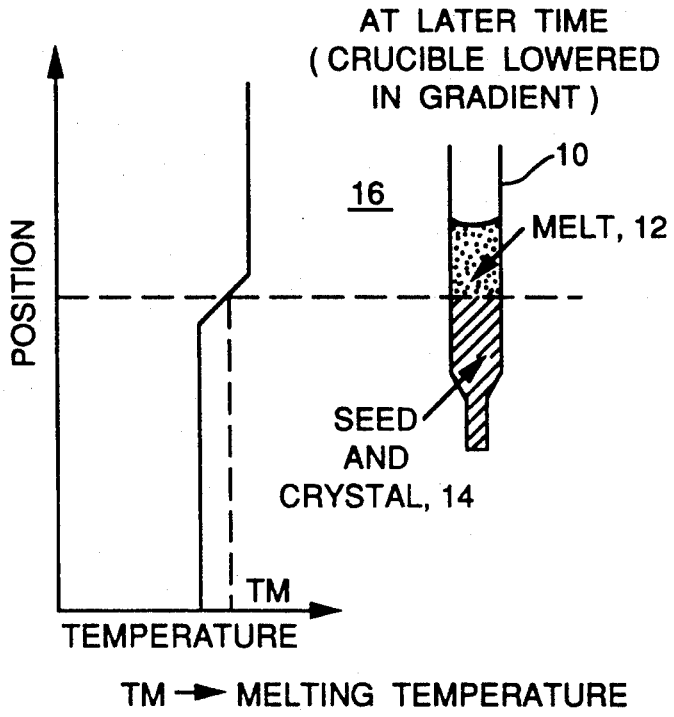
FIG. 1 PRIOR ART
FIG. 1 illustrates the Bridgman growth techniques.
Figure 2:
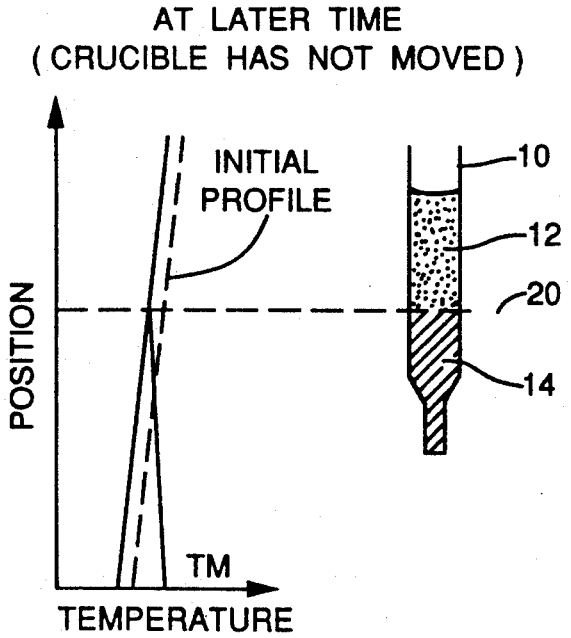
FIG. 2 PRIOR ART
FIG. 2 illustrates the gradient freeze technique.

Referring to FIGS. 1 and 2, FIG. 1 discloses the conventional Bridgman growth technique having a crucible 10 with a crystal melt 12 therein. The position-temperature graph illustrates the necessity of having accurate control over the temperature and, in particular, the temperature gradient that occurs between the melt 12 and a forming crystal 14. The gradient in the Bridgman growth technique is fixed within the growth furnace, not shown, and the crucible 10 is translated across the fixed gradient to grow the crystal 14. The temperature in the hot zone 16 and the temperature in the cool zone 18 establishes the difference in temperature, and the design of the furnace positions this difference in a particular area to establish the proper temperature gradient for the type of crystal being formed.

Referring to FIG. 2, this illustrates the gradient freeze technique to grow single crystals also. In this technique a temperature gradient is established along the length of the crucible 10 with the melt freezing temperature initially occurring at the seed. The temperature is decreased uniformly along the length resulting in the crystal growing from the seed as the temperature is lowered at the interface. From this it is clear that the furnace must have an accurate temperature gradient but also as the temperature changes, the gradient must still occur.

Figure 3:
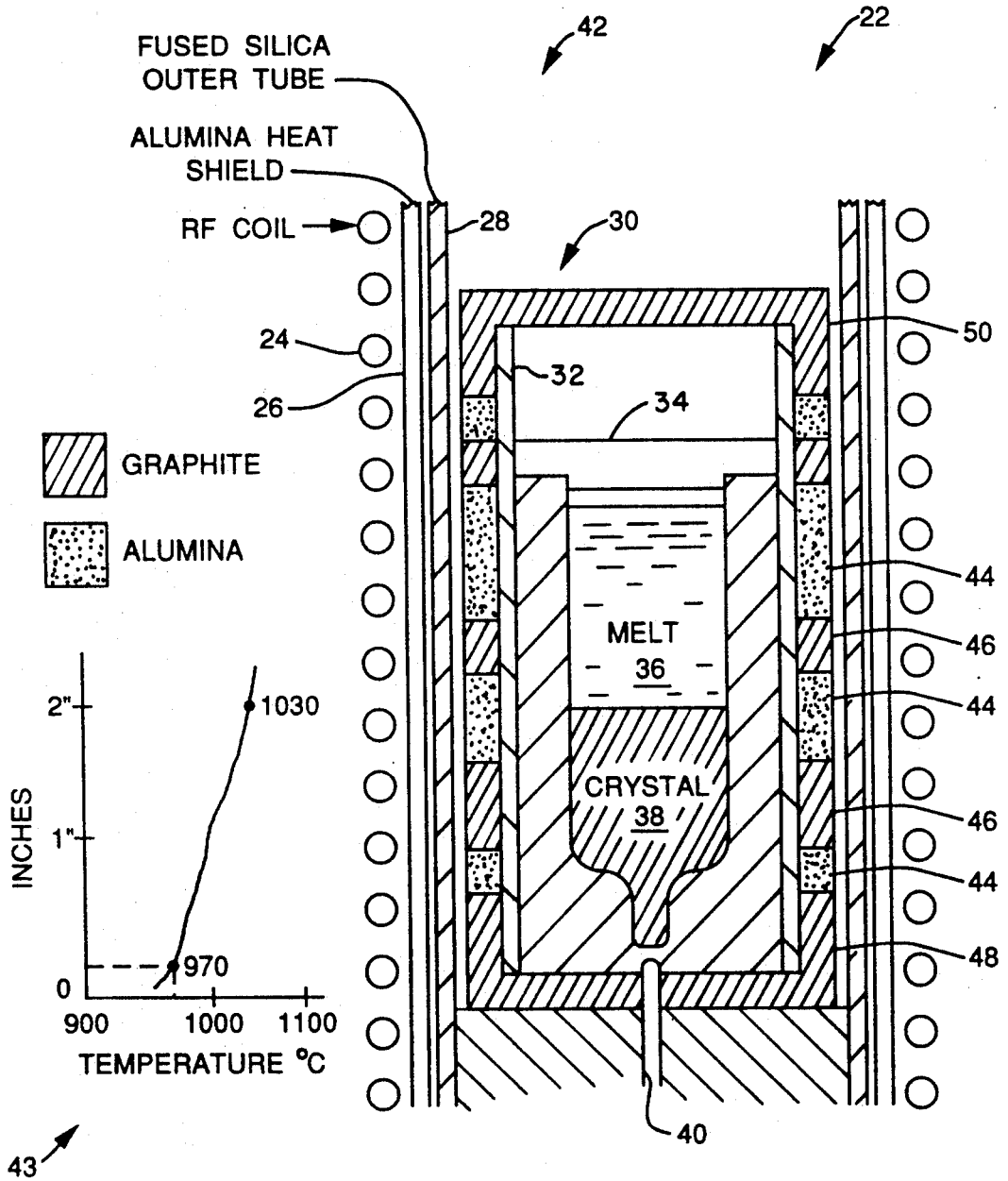
FIG. 3 illustrates by partial cross section the furnace having the invention therein.

Referring to FIG. 3, a partial view in cross section of a crystal growth furnace 22 is shown. Other conventional features of the furnace 22 are not shown such as power lines, power source, a chamber thereabout for controlling the atmosphere; gas inputs, outputs, and sources; and means for moving the crucible, etc.

As seen in FIG. 3, radio frequency (RF) coils 24 surround a heat shield 26, an outer insulating tube 28, a heat controlling means being a composite susceptor 30, an inner insulating tube 32, a crucible 34 having therein a melt 36 and a crystal 38 with a thermocouple 40 therein for measuring temperature. A position-temperature graph 43 illustrates a typical temperature gradient obtained therein by this invention.

FIG. 4 illustrates the elements of a temperature gradient controlling means 42 in greater detail. FIG. 4A is the outer insulating tube 28 having an inner diameter (ID) R; FIG. 4B is the inner insulating tube 32 having an outer diameter (OD) of d; FIG. 4C illustrates an insulating element 44; FIG. 4D illustrates a conducting element 46; FIG. 4E illustrates a bottom cap 4B and FIG. 4F illustrates a top cap 50.

Although the elements of the temperature gradient controlling means 42 are preferably cylindrically shaped because of uniformity and ease of manufacture other shapes are possible. Although cylindrical geometries may be the easiest to use for this type of RF furnace, other geometries are possible providing that the coil and the susceptor arrangements provide uniform properties in that geometry. Even if it is not possible to accurately establish a uniform environment with the coil and susceptor geometry, use of materials which are good thermal conductors, either isotropic or anisotropic (i.e., pyrolytic graphite or PBN) may establish enough homogeneity to make some applications practical.

The bottom cap 48, the insulating element 44, the conducting element 46, and the top cap 50 may be constructed so that they are keyed to each other for support. For example, the bottom cap 48 has a cylindrical cavity 52 therein with a circumferential step 54. If the insulating element 44 is placed on the bottom cap 48, a key ring 56 fits into the cavity 52 and rests on the step 54. An upper ring 58 having a larger outer diameter than the key ring 56 rests on the top 60 of the bottom cap 48. The insulating element 44 has a cylindrical cavity 62 with a circumferential channel 64 thereabout so that the next element being similarly constructed may be seated therein. The cylindrical cavity 62 has a diameter d so that the inner tube 32 may fit therein. The conducting element 46 is similarly constructed as the insulating element 44. The element 44 and 46 are stacked as schematically shown in FIG. 3 to achieve the proper temperature gradient in the composite susceptor 30. The top cap 50 is similarly constructed as elements 44 and 46 except there is no cavity therein. The keying of the elements is preferred although flat rings are also possible for stacking.

For experimental purposes, the conducting and insulating elements 46 and 44 should be fabricated in standard sizes, either in uniform length cylindrical sections, or in multiples of a minimum length. The minimum length should be short compared to the total length of the RF furnace (e.g., not more than 5%). The caps 48 and 50 of conducting materials may be used to minimize edge effects induced by the magnetic fields. A small hole 66 in the bottom cap 48, for example, may provide support to the crucible 34 and to probe the internal temperatures.

Internal and external insulating tubes 28 and 32 serve two functions. The inner tube 32 may provide physical support for the furnace 22, and both tubes 28 and 32 may be used to further modify the thermal environment in the furnace 22. Thus, for example, tubes 28 and 32 with a large thermal conductivity will lower and smooth both axial and radial gradients in the furnace 22.

Once a suitable thermal environment has been established in the furnace, sections of the susceptor 30 which consist of several adjacent conducting or insulating elements may be replaced by monolithic segments of the same total length if desired. This leads to a furnace with fewer elements, which is more suitable for repetitive production applications.

The furnace 22 of FIG. 3 was used to grow germanium by the gradient freeze technique as shown in FIG. 2. The conducting elements 46 were fabricated from graphite and the insulating elements 44 were fabricated from alumina. The internal and external tubes were fused silica. The RF coil 24 used was a uniform helix. The initial gradient is shown in graph 43. The smallest gradient over a four inch length which could be established using a monolithic conducting element, susceptor, in this geometry averaged larger than 35 degrees C./cm. As is shown on the FIG. 3, gradients averaging less than 12 degrees C./cm were produced in the area of interest using a composite susceptor 30.

Two materials for conducting and insulating elements 46 and 44 in a composite susceptor 30 are pyrolytic graphite and pyrolytic boron nitride. In disk geometries these materials are available in thicknesses of approximately one mm. The materials as formed, however, are highly anisotropic in their properties.

Both pyrolytic graphite (PG) and pyrolytic boron nitride (PBN) have much higher thermal conductivity within the plane of a disk geometry than they do perpendicular to it (50–200 times greater). PG is a good conductor in the plane of the disk while PBN is a good insulator. The anisotropy in the materials is due to the fact that during their formation by chemical deposition, the crystallographic c-axis is invariably perpendicular to the direction in which the material is growing. The anisotropies observed are due to the layer lattice structures of these materials. A furnace constructed of conducting and insulating elements of these materials will exhibit exceptionally good radial thermal symmetry due to the high thermal conductivity circumferentially within the elements, and yet be able to maintain locally axial gradients due to the low thermal conductivity from element to element. Heat may be removed readily from the outer circumference of the furnace because of the essentially radial heat flow provided by these materials.

An RF furnace using a composite susceptor fabricated of insulators and electrical conductors is relatively simple, and for many materials choices, is also inexpensive. Experimental arrangements with relatively uncomplicated thermal environments can be assembled from readily available materials in a matter of days, and rearranged and probed in a matter of hours. More stringent or more complicated profiles can be attained with more exotic materials. The furnace with the composite susceptor 30 allows for duplication of thermal conditions previously attainable only in custom designed resistance heated furnaces with multiple power supplies and control loops. Control of temperature conditions within the furnace is intuitive, i.e. if an area is too hot some of the conducting elements in that area should be replaced by insulating elements. Some additional modifications of the thermal environment may be made by changing coil geometry or using a variety of heat shields.

Clearly, many modifications and variations of the present invention are possible in light of the above teachings, and it is, therefore, understood that within the inventive scope of the inventive concept, the invention may be practiced otherwise than specifically claimed.

What is claimed is:

1. A composite susceptor for use in a radio frequency heated furnace. said composite susceptor comprising:

at least one electrically insulating element, said insulating element having a cavity therethrough; and at least one electrically conducting element, said at least one conducting element generating heat as a function of radio frequency current in RF coils, said at least one conducting element being stacked with said at least one insulating element, said at least one conducting element having a cavity therethrough that coincides with said cavity of said at least one insulating element, said at least one electrically insulating element preventing heat generated by radio frequency waves, said at least one electrically insulating element modify temperature gradients in combination with said at least one conducting element, an object to be heated placed within the cavities of said at least one insulating and conducting elements.

2. A composite susceptor as defined in claim 1 further including a bottom cap for said composite susceptor.

3. A composite susceptor as defined in claim 2 wherein said bottom cap is electrically conducting.

4. A composite susceptor as defined in claim 1 further including a top cap for said composite susceptor.

5. A composite susceptor as defined in claim 4 wherein said top cap is electrically conductive.

6. A composite susceptor as defined in claim 1 further including an inner tube, said inner tube being positioned in the cavities and between said elements and an object to be heated.

7. A composite susceptor as defined in claim 6 wherein said inner tube is an electrical insulator.

8. A composite susceptor as defined in claim 1 further including an outer tube, said outer tube being positioned outside said elements.

9. A composite susceptor as defined in claim 8 wherein said outer tube is a electrical insulator.

10. A composite susceptor as defined in claim 1 wherein said at least one electrically insulating element and said at least one electrically conducting element are alternately stacked to form said composite susceptor.

11. A composite susceptor as defined in claim 1 wherein said at least one electrically conducting element is made of a material select from the group consisting of graphite, pyrolytic graphite, refractor metals and precious metals.

12. A composite susceptor as defined in claim 1 wherein said at least One electrically insulating element is made of a material selected from the group consisting of alumina, zirconia ceramic, fused silica, hot pressed boron nitride, beryllia, mullite and aluminum nitride.

13. A composite susceptor as defined in claim 1 wherein said elements and a top and a bottom cap are keyed to provide physical support.

14. A composite susceptor as defined in claim 1 wherein said elements are of a height of at least about 5 per cent of a furnace length.

15. A composite susceptor as defined in claim 1 further including an inner tube and an outer tube which are about said susceptor having large thermal conductivity to modify temperature gradients for crystal growth.

16. A composite susceptor as defined in claim 15 wherein the inner and outer tubes are made of fused silica.

17. A composite susceptor as defined in claim 1 wherein said conductive element is made of pyrolytic graphite and said insulator element is made of pyrolytic boron nitride, said elements being disk shaped having anisotropic thermal conductivity in a radial plane being perpendicular to a susceptor axis.

18. A method of controlling the temperature gradients in an radio frequency (RF) heated furnace, said method comprising the steps of:

positioning about a heating area having an object to be heated a plurality of electrically insulating and conducting elements, said elements having a cavity therethrough wherein the heating area is established, said elements being alternative stacked to form said cavity, and said conducting element generates heat as a function of radio frequency current in RF coils.

19. A method as defined in claim 18 wherein said at least one electrically conducting element is made of a material selected from the group consisting of graphite, pyrolytic graphite, refractory metals and precious metals.

20. A method as defined in claim 18 wherein said at least one electrically insulating element is made of a material selected from the group consisting of alumina, zirconia ceramic, fused silica, hot pressed boron nitride, beryllia, mullite and aluminum nitride.

21. A method as defined in claim 18 wherein said insulating and conducting elements are of a standardized length, said length being not less than 5 percent of furnace lengths whereby the insulating and conducting elements are positioned to tailor the temperature gradients.

22. A method as defined in claim 21 wherein similar adjacent elements are replaced by a monolithic element after tailoring of the temperature gradients.

23. A method as defined in claim 18 wherein said elements may selectively have anisotropic thermal conductivity.

* * * * *